US005615947A

United States Patent [19]

Shambo et al.

[11] Patent Number: 5,615,947

[45] Date of Patent: Apr. 1, 1997

[54] LUMINAIRE SHIELD

[75] Inventors: George Shambo, Davie; Robert B. Hodson, Boca Raton; Robert C. Blackburn, Miami, all of Fla.

[73] Assignee: Florida Power & Light Co., Miami, Fla.

[21] Appl. No.: 371,741

[22] Filed: Jan. 12, 1995

[51] Int. Cl.[6] ..... F21V 15/00

[52] U.S. Cl. ..... 362/376; 362/375; 362/268; 362/294

[58] Field of Search ..... 362/294, 360, 362/268, 255, 256, 332, 307, 308, 310, 311, 355, 373, 374, 375, 376, 306

[56] References Cited

U.S. PATENT DOCUMENTS

| | | | |
|---|---|---|---|
| 1,923,970 | 8/1933 | Dowling | 362/376 |
| 3,267,279 | 8/1966 | Doolittle | 362/268 |
| 4,010,362 | 3/1977 | Fletcher | 362/375 |
| 4,160,286 | 7/1979 | Merritt | 362/311 |
| 4,432,045 | 2/1984 | Merritt | 362/375 |
| 4,434,456 | 2/1984 | Taylor | 362/376 X |
| 4,460,945 | 7/1984 | Chan et al. | 362/294 |
| 4,894,761 | 1/1990 | Gray | 362/376 |
| 5,016,151 | 5/1991 | Mula | 362/267 |

*Primary Examiner*—Ira S. Lazarus
*Assistant Examiner*—Thomas M. Sember
*Attorney, Agent, or Firm*—Amster, Rothstein & Ebenstein

[57] ABSTRACT

A shield is provided for a luminaire or street lamp of the type which includes an open-bottom housing for a light source and a lens-bearing door movably mounted on the housing for closing the bottom thereof and mounting a lens below the light source. The shield is formed of an overlapping pair of substantially rigid but slightly flexible transparent planar panels separated by an air gap, with a first plurality of resilient spacers disposed intermediate the panels and providing the air gap. The shield is easily and rapidly mounted on the bottom of the housing to protect the lens and the light source, with a second plurality of resilient spacers disposed intermediate the door and an adjacent one of said panels and providing an air gap therebetween.

23 Claims, 5 Drawing Sheets

LUMINAIRE SHIELD

BACKGROUND OF THE INVENTION

The present invention relates to luminaires or street lights and, more particularly, to a shield for protecting the lens and light source thereof.

Typically a luminaire or street light includes an open-bottom housing for a light source and a lens-bearing door movably mounted on the housing for closing the bottom thereof and for mounting a lens below the light source. The housing includes a socket for the lamp source. The lens may be light-diffusing or simply a clear lens disposed so as to protect the light source. The lens is mounted on a door which is pivotally secured to the housing and movable between a raised orientation for protecting the light source and a lowered orientation enabling access to the light source—for example, for replacement thereof. While the lens provided in the door is typically adequate to protect the light source against unintended accidental impacts from projectiles, it has not been found adequate to protect the light source against vandals who are intentionally attacking the luminaire, frequently with guns ranging from the homemade pistol to an assault rifle.

U.S. Pat. No. 4,460,945 discloses a luminaire shield formed of a transparent laminate, commercially known as LEXGARD and formed of two polycarbonate sheets (commercially available under the mark LEXAN) with acrylic material therebetween. The laminate is about 0.75 inch thick, and the shield is spaced from the luminaire by spacer elements for ventilation purposes.

The laminate shield described above has not proven to be satisfactory in use. The laminate duly performs its function of protecting the light source from damage due to the impact of many projectiles (including pistol bullets) which cannot penetrate the laminate. However, such projectiles may at least partially delaminate the laminate, thereby reducing the light transmissiveness of the laminate due to the irregular refractive air space formed by the delamination. The degree of delamination appear to increase over time after the initial impact, so that the loss of light transmission is progressive. Inasmuch as eventually the luminaire does not provide adequate illumination through the delaminated laminate, the shield must be replaced, thus requiring both a costly service call and a costly new shield.

Another approach taken by the vandals has been to attack the connection between the shield and the luminaire. This has included both the direct approach of attempting to shoot out any means structurally connecting the shield to the luminaire and the indirect approach of simply repeatedly impacting the shield with projectiles so that the resultant vibrations cause the connected elements to separate. In either case, once the shield is gone from the luminaire, the luminaire is susceptible to conventional attack.

Further complicating the situation is the fact that the shields are often difficult to properly mount onto the luminaire, thereby increasing the time and thus the cost of a shield replacement.

Accordingly, it is an object of the present invention to provide a shield for a luminaire which will stop projectiles (including bullets) from piercing the shield and damaging the light source.

Another object is to provide such a shield which will not shatter, delaminate or otherwise undergo a substantial reduction of light transmissiveness as the result thereof.

A further object is to provide such a shield which offers protection to the means connecting the shield to the luminaire and which resists disengagement of the connected elements due to vibration.

It is also an object of the present invention to provide such a shield which may be easily and rapidly mounted and/or replaced on a luminaire.

SUMMARY OF THE INVENTION

The above and related objects of the present invention are obtained in a shield for a luminaire of the type which includes an open-bottom housing for a light source and a lens-bearing door movably mounted on the housing for closing the open bottom thereof and for mounting a lens below the light source. The shield comprises an overlapping pair of substantially rigid but slightly flexible transparent planar panels separated by an air gap. A plurality of resilient spacers are disposed intermediate the panels and establish the air gap. Means are provided for mounting the shield on the bottom of the housing to protect the lens and the light source.

In a preferred embodiment, the shield has a planar surface adjacent and substantially parallel to the lens. The panels are polycarbonate, about 0.5" thick, and substantially vertically aligned. The spacers are slightly shock-absorbing and about 0.2–0.5" long. A second plurality of resilient spacers are disposed intermediate the door and an adjacent one of the panels and provide an air gap therebetween.

Preferably the luminaire door has apertures and is pivotally secured to the back of the housing. The luminaire additionally includes a resilient releasable latch for releasably securing the door to the front of the housing, the latch having one latch end portion secured to the door, another latch end portion pivotable between a non-engaging orientation wherein it does not engage the housing and an engaging orientation wherein it is loosely and releasably secured to the housing, and a latch intermediate portion connecting the latch end portions. The mounting means includes at one end of the shield a pair of nut-and-bolt assemblies for releasably mounting the one shield end to the door apertures and at the other end of the shield means for loosely and releasably engaging the latch intermediate portion.

The present invention also encompasses a shield for a luminaire of the type which includes a housing for a light source, a lens-bearing door with apertures pivotally secured to the back of the housing, and a resilient releasable latch for releasably securing the door to the front of the housing. The latch has one latch end portion secured to the door, another latch end portion pivotable between a non-engaging orientation wherein it does not engage the housing and an engaging orientation wherein it is loosely and releasably secured to the housing, and a latch intermediate portion connecting the latch end portions. The shield comprises an overlapping pair of substantially rigid but slightly flexible transparent planar panels separated by an air gap and held together by a plurality of bolt-and-nut assemblies. A plurality of resilient spacers are disposed on the bolts of the assemblies intermediate the panels to provide the air gap and on the bolts of the assemblies above the upper panel to space the upper panel from the door. Means are provided for mounting the shield on the bottom of the housing to protect the lens and the light source. The mounting means includes adjacent one end of the shield at least one bolt of the assemblies extending through a respective aperture in the door for releasably mounting the one shield end on the door with a nut, and adjacent the other end of the shield means for loosely and releasably securing the other end of the shield to the latch intermediate portion.

In a preferred embodiment, the securing means includes a tang secured to the upper panel and defining therewith a resiliently openable clip for loosely and releasably receiving and maintaining therein the latch intermediate portion.

BRIEF DESCRIPTION OF DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
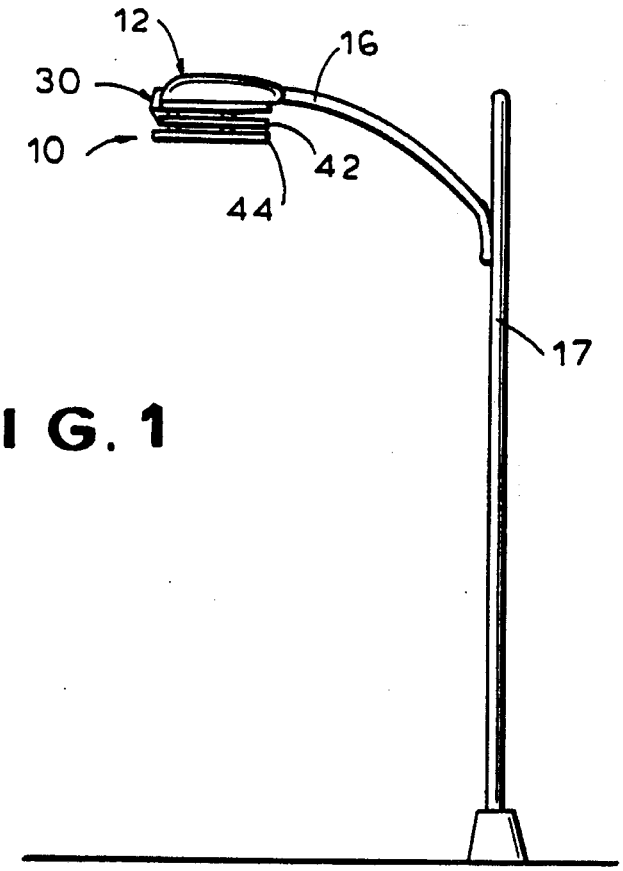
FIG. 1 is a side elevational view of a luminaire with a shield of the present invention thereon in an environment of use.
Figure 7:
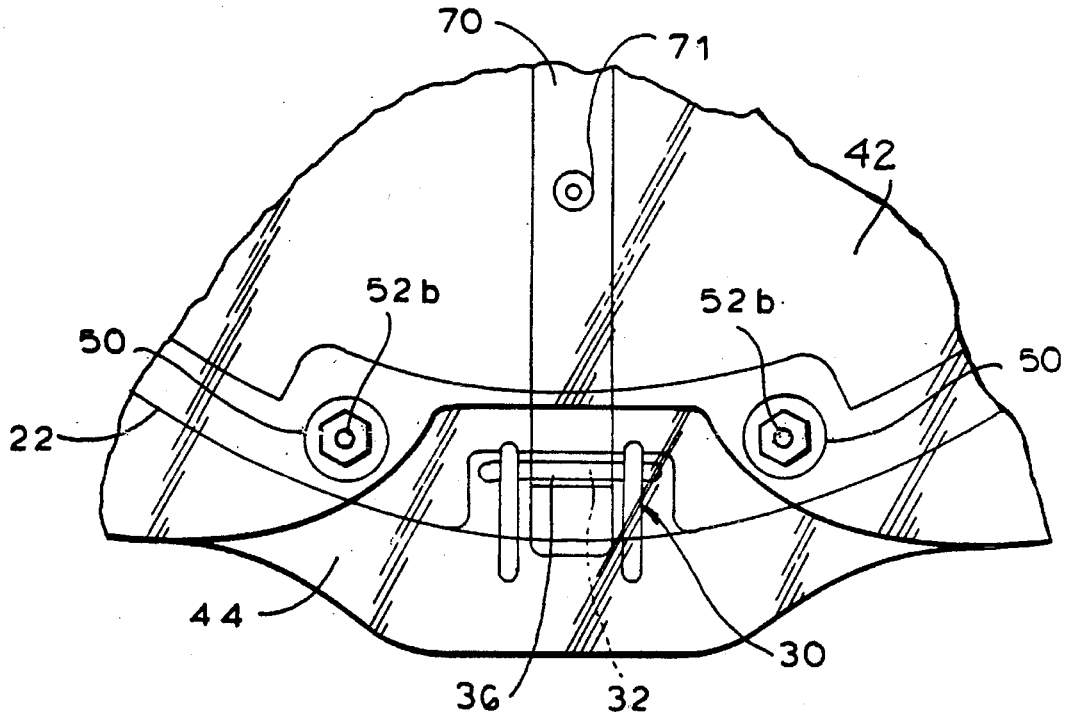
FIG. 7 is a bottom plan view.

Referring now to the drawing, and in particular to FIG. 1 thereof, therein illustrated is a shield according to the present invention, generally designated by the reference numeral 10. The shield 10 is mounted on a luminaire of the conventional street light type, generally designated 12. The luminaire 12 includes a housing 14 which is mounted at the end of an arm 16 attached to a street light standard or pole 17.

Figure 2:
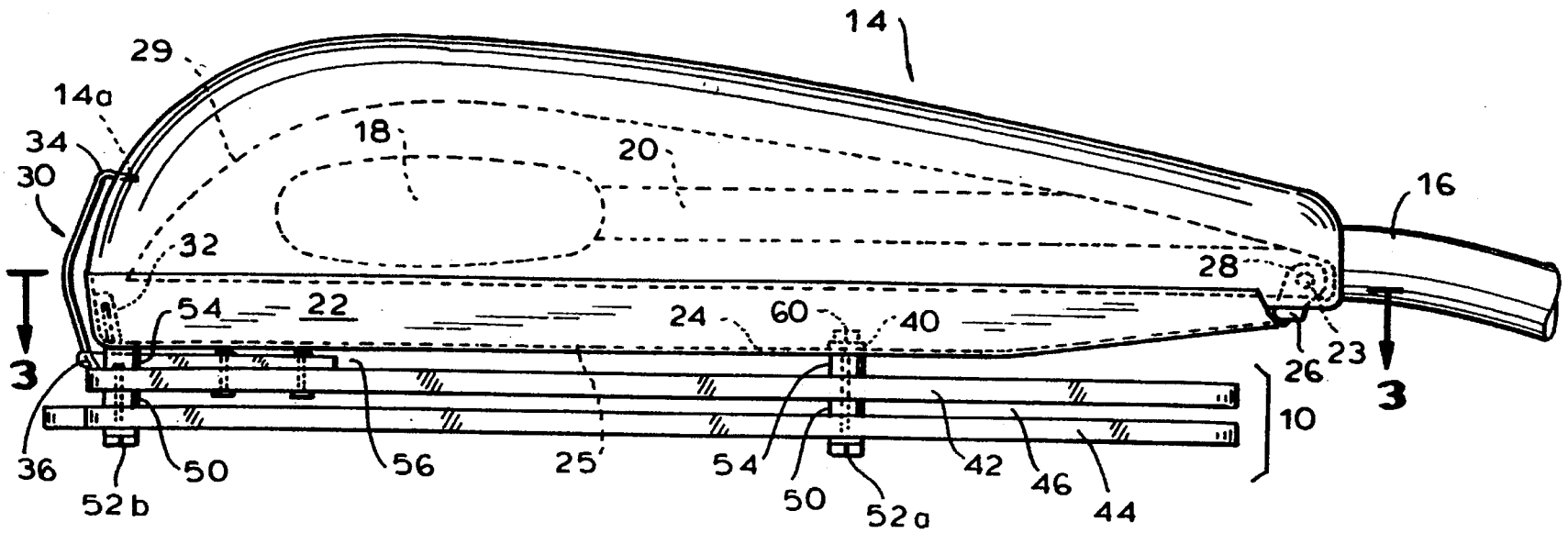
FIG. 2 is a fragmentary side elevational view thereof, to an enlarged side, with the shield in the latched orientation.
Figure 3:
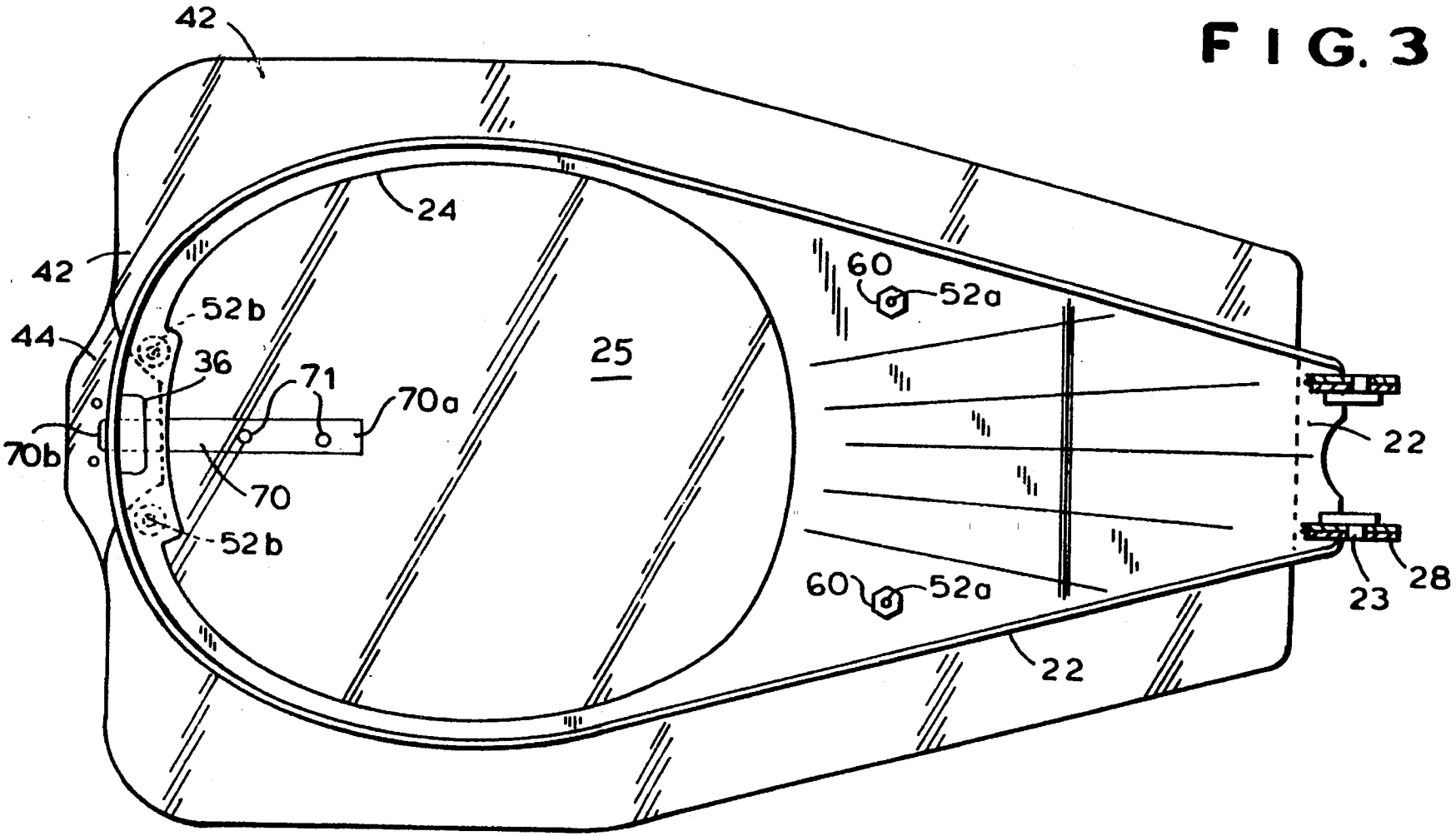
FIG. 3 is a sectional view taken along the line 3—3 of FIG. 2.
Figure 6:
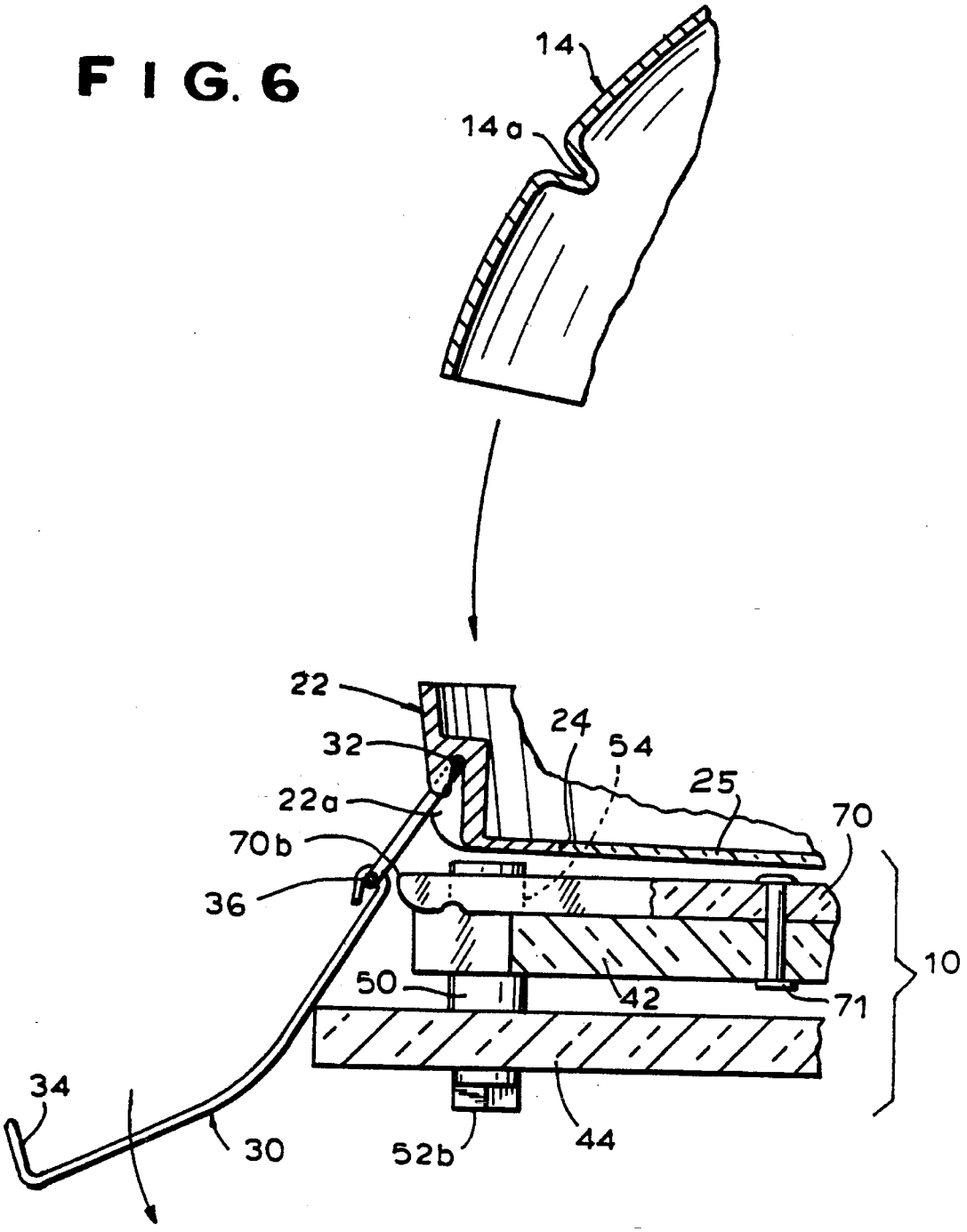
FIG. 6 is a view similar to FIG. 5, but showing the separation of the front of the shield and the door from the front of the housing.

Referring now to FIGS. 2 and 3 in particular, a light source or lamp 18 is disposed within the housing 14, typically by a lamp socket 20 for receiving the lamp 18. The lamp socket 20 is typically mounted adjacent the rear of the housing 14 and may include an electrical converter element or ballast, as necessary for particular types of lamps 18. At least the major portion of the bottom of the housing 14 is open, and a door 22 defining a window 24 therethrough is movably mounted on the housing 14 for closing the open bottom thereof and optionally for mounting a lens 25 in the window 24 below the light source or lamp 18. The door 22 is typically pivotally mounted at 23 at the back of the housing 14 for movement between a lowered or repair orientation wherein it enables authorized personnel access to the interior of the housing—for example, for replacement of the light source 18, its socket 20 or a ballast therein—as illustrated in FIG. 6, and a raised or use orientation wherein it operatively closes the open bottom of the housing 14, as illustrated in FIG. 2. A lens 25 is optionally mounted in window 24 of the door 22 so that, when the door 22 is in the raised orientation, the lens is spaced below the light source 18. The lens 25 may be either a clear lens or a light-diffusing lens according to the nature of the light source 18 and luminaire 12. Typically the door 22 has a pair of pivot elements 26 disposed adjacent the rear thereof for being received in appropriately configured and dimensioned slots 28 at the rear of the housing 14, thereby to enable pivotal movement of the door 22 relative to the housing 14.

A reflector or refractor 29 may optionally be disposed within the housing and mounted adjacent the rear of the housing coaxially with the door 22 so that the door 22 and the reflector/refractor 29 are each independently pivotally movable relative to the housing 14, between a raised or use orientation and a lowered or repair orientation.

A resilient releasable latch, generally designated 30, enables the door 22 to be releasably secured to the front of the housing 14. The latch 30 has one latch end portion 32 secured to the door 22 or captured in a recess **22*a* in the door 22 adjacent to the front thereof, another latch end portion 34, and a latch intermediate portion 36 pivotally connecting the latch end portions 32, 34. The latch is pivotable between a non-engaging orientation wherein the latch end portion 34 does not engage a recess 14*a* in the front part of the housing 14 (see FIG. 6 and the latch in dashed line of FIG. 5) and an engaging orientation wherein it is loosely and releasably secured to the front part of the housing 14, (see FIGS. 1–4, 6 and the latch in solid line of FIG. 5). Typically the latch 30 remains secured by end portion 32 to the door 22 and, when it is desired to lock the door 22 in its raised orientation to the front part of the housing 14, first the latch end portion 34 is pressed against the housing front recess 14*a* and then the latch intermediate portion 36 is pressed rearwardly toward the housing 14 to lock the latch 30** in its raised orientation.

The luminaire 12 described above is conventional in design and well known to those skilled in the luminaire art. For example, it is the type of luminaire commonly used by Florida Power and Light Company in Miami, Fla. Accordingly, it is not deemed necessary to provide further details thereof herein.

The only modification of the conventional luminaire, as described above, that may be required to render it useful with the present invention is the provision of two bolt-receiving apertures 40 adjacent the rear of the door 22 for purposes which will become apparent hereinafter. The lens 25 in door window 24 is preferably retained for its protective environmental function—i.e., to exclude flying insects, birds, dirt, etc.)

The shield 10 according to the present invention comprises an overlapping pair of planar panels 42, 44 separated by an air gap 46. The panels 42, 44 are substantially rigid but (most importantly) slightly flexible. In other words, they resiliently resist flexure. They are conveniently formed of polycarbonate sheets (available under the trademark LEXAN) about 0.5 inch thick. The configuration and size of the panels will be determined, of course, by the areas to be protected and will vary with different size luminaires. The panels are preferably substantially vertically aligned substantially overlying) when the door 22 is in the raised or bottom-closing use orientation. The upper surface of the upper panel 42 is substantially planar and preferably substantially parallel to the lens 25 within window 24 when the door 22 is in the raised or use orientation.

Figure 5:
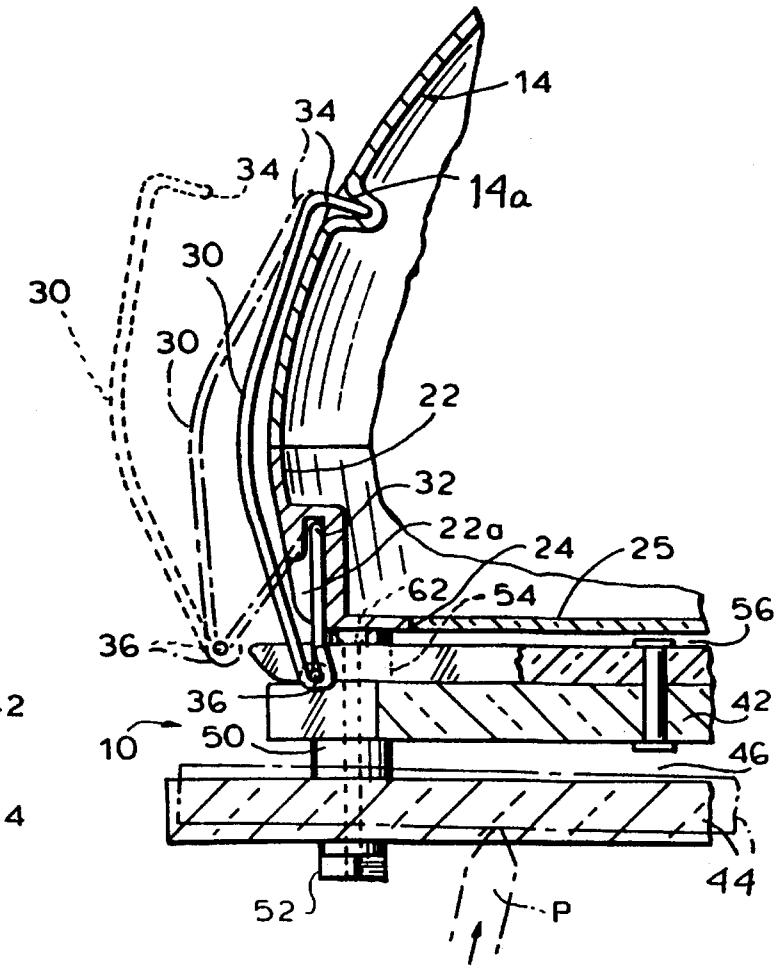
FIG. 5 is a sectional view taking along the line 5—5 of FIG. 4, with portions cut away to reveal details of internal construction, with the latch shown in a locked orientation in solid line, an intermediate orientation in phantom line, and a released orientation in dotted line, and with a bullet illustrated in the phantom line moving the bottom layer of the shield from the orientation shown in solid line to the orientation shown in phantom line.
Figure 4:
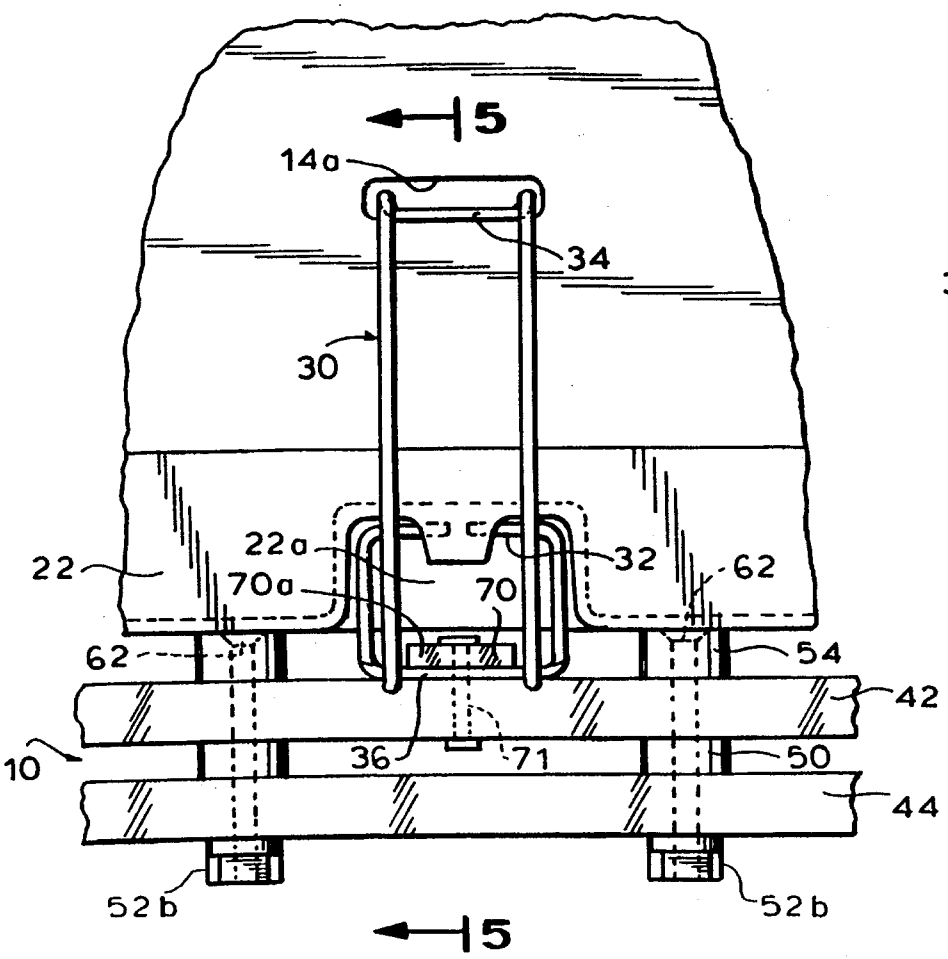
FIG. 4 is a fragmentary front elevational view, to an enlarged scale, with the shield in the latched orientation.

A first plurality of resilient spacers 50 are disposed intermediate panels 42, 44 and provide the air gap 46 therebetween. Preferably, two spacers 50 are disposed adjacent the front of the shield and two spacers 50 are disposed adjacent the rear of the shield. Bolts 52 extend upwardly, from below the lower panel 44, through the lower panel 44, spacer 50, air gap 46, and upper panel 42, and then project further upwardly. A second plurality of resilient spacers 54 is disposed about the upwardly projecting ends of the bolts 52 above the upper surface of the upper panel 42. The second plurality of resilient spacers 54 is disposed intermediate the upper panel 42 and the door 22 and provide an air gap 56 therebetween when the door 22 is in the raised orientation. Preferably, two spacers 54 are disposed adjacent to the front of the shield and two spacers 54 are disposed adjacent to the rear of the shield. The spacers 50, 54 are preferably formed of nylon or another slightly shock-absorbing resilient material (such as a linear polyoxymethylene-type acetal resin available under the trademark DELRIN) and are preferably about 0.2–0.5 inch long, the spacers 54. Preferably being larger than the spacers 50, although various factors n,ay influence the length thereof including the size of the panels 42, 44, the types of projectiles which are expected to impact upon the shield 10 and the design of the housing 14. As illustrated in FIG. 5, the spacers 50 provide an air gap 46 in order to enable the lower panel 44 to resiliently flex upwardly (to the orientation illustrated in phantom line) without shattering when impacted by a projectile. The spacers 54 provide an air gap 56 in order to enable the upper panel 42 to resiliently flex upwardly without shattering when impacted by a projectile which has gone through lower panel 44 or in response to a severe upward deflection of the lower panel 44 (in response to the impact of a projectile) which contacts upper panel 42. The resilient flexing of the panels 42 and 44 affords to a large degree a shock-absorbing (i.e., energy-absorbing) characteristic to the shield.

It will be appreciated that the two bolts **52*a* adjacent to the rear of the shield are longer than the two bolts 52*b* adjacent to the front of the shield. In a preferred embodiment of the shield, the bolts 52*a* extend upwardly (through the lower panel 44, the lower spacer 50, the upper panel 42 and the upper spacer 54) and terminate about an inch above the top of the upper spacer 54 thereon. A nut 60 is screwed on the threaded upper end of bolt 52*a* to maintain the spacers 50, 54 and panels 42, 44 in series contact. By way of contrast, the bolts 52*b* extend upwardly in a similar manner but terminate within the upper spacer 54. A small diameter nut 62 is screwed on the threaded upper end of bolt 52*b* to maintain the spacers 50, 54 and panels 42, 44 together without extending upwardly above the top of the spacers 54. Preferably, lock washers (not shown) are interposed between the nuts 60, 62 and the upper spacers 54 (or door 22, when the shield 10** is installed).

For reasons which will become apparent later, a tang 70 is secured at 71 to the upper surface of the upper panel 42 and defines with the upper planar surface of the upper panel 42 a resilient openable clip for loosely and releasably receiving and maintaining therein the latch intermediate portion 36. The tang 70 is preferably formed of polycarbonate (the same material as the panels 40, 42) and in the form of an elongate bar. One tang end **70*a* is secured to the upper surface of the upper panel 40, leaving the other tang end 706 (adjacent the front of upper panel 40) resiliently pivotable upwardly and away from the upper surface of the upper panel 42. Typically the lower surface of the tang end 70*a* is recessed or grooved for receiving therein the latch intermediate portion 36**.

Now that the shield 10 and the luminaire 12 have each been separately described, the method of mounting the shield 10 on a luminaire 12 will now be described in the context of the installation process. When the installer arrives at the luminaire, he pushes or pulls the latch intermediate portion 36 forwardly to release the latch 30 and allow the latch end portion 34 to be separated from the housing front recess **14*a* and moved into the non-engaging orientation (see FIG. 5 in phantom and dashed line). This allows door 22 to drop into the lowered orientation (see FIG. 6). At this point, the nuts 60 are removed from the bolts 52*a* adjacent to the rear of the shield 10, and the ends of the bolts 52*a* are then inserted the bolt-receiving apertures 40 adjacent to the rear of the door 22. The nuts 60 are then screwed back onto the exposed ends of bolts 52*a* so that the door 22 is secured on bolts 52*a* between the nuts 60 (or lockwashers) and the upper spacers 54**.

At this point the door 22 is returned to its raised orientation, the latch end portion 34 is pivoted to the engaging orientation with the housing front recess **14*a*, and finally the latch intermediate portion 36 is moved rearwardly so that it enters the clip between upper panel 42 and the tang 70 (see FIG. 5 in solid line). Thus the latch 30 now performs the double function of securing the door 22 to housing 14 in the front and at the same time securing the shield 10 to the door 22 (with spacers 54 intermediate door 22 and the upper panel 42**) in the front.

In the final luminaire-shield assembly, the lower panel 44 preferably extends forwardly of the upper panel 42 a distance sufficient to provide at least some protection for the latch 30 against direct impact from projectiles (see FIGS. 2–3 and 5–6). Additionally, the resiliency of the latch 30 and the looseness of its connection to the door 22, housing 14 and upper panel 42 provide a resiliently flexible connection which resists separation of the connected elements due to vibration.

Shield installation or replacement time for an experienced serviceman is estimated to be about 5 minutes, thereby substantially reducing the time and labor costs associated with conventional shield installation or replacement.

As a conventional laminated shield typically undergoes a severe and progressive impairment of its light transmissiveness after performing its function of protecting the luminaire from impact by a projectile, it must shortly thereafter be replaced if the luminaire is to serve its function of illumination. By way of contrast, the non-laminated shield 10 according to the present invention undergoes no loss in light transmissiveness after performing its function of protecting the illuminaire from impact by a projectile, or at most it undergoes a relatively minor, localized and non-progressive loss of light transmissiveness. Accordingly, the shield of the present invention does not require replacement after each encounter with a projectile and is therefore more economical to use both in terms of manufacturing costs and installation costs.

To summarize, the present invention provides a shield for luminaire which will stop projectiles (including pistol bullets) from piercing the shield and damaging the lens or light source, yet will not shatter, delaminate or otherwise undergo a substantial reduction of light transmissiveness as the result thereof. The shield offers protection to the means connecting the shield and luminaire and resists disengagement of the connection due to vibration. The shield is easily and rapidly mounted and/or replaced on a luminaire.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

We claim:

1. A shield for use on a luminaire which includes a front, a back, an open-bottom luminaire housing for a luminaire light source and a lens-bearing luminaire door movably mounted on the luminaire housing for closing the open bottom thereof and for mounting a luminaire lens below the luminaire light source, said shield comprising:

(A) an overlapping pair of substantially rigid but slightly flexible transparent planar panels separated by an air gap;

(B) a plurality of resilient spacers disposed intermediate said panels and providing the air gap, and (C) means for mounting said shield on the bottom of the luminaire housing to protect the luminaire lens and the luminaire light source.

2. The shield of claim 1 wherein said shield has a planar surface adjacent and substantially parallel to a luminaire lens.

3. The shield of claim 1 wherein said panels are polycarbonate and about 0.5" thick.

4. The shield of claim 3 wherein said spacers are slightly shock-absorbing and about 0.2–0.5" long.

5. The shield of claim 1 wherein said panels are substantially vertically aligned.

6. The shield of claim 1 additionally including a second plurality of resilient spacers disposed on one side of said panels for positioning intermediate a luminaire door and an adjacent one of said panels and providing an air gap therebetween.

7. The shield of claim 1 wherein said panels are formed of plastic.

8. The shield of claim 1 wherein each of said resilient panels defines an outer periphery, and at least at least some of said plurality of resilient spacers are spaced inwardly of said panel outer peripheries.

9. A shield luminaire including (A) a luminaire comprising:

(i) an open-bottom housing for a light source; and (ii) a lens-bearing door movably mounted on said housing for closing the open bottom thereof and for mounting a lens below the light source; and (B) a shield comprising:

(i) an overlapping air of substantially rigid but slightly flexible transparent planar panels separated by an air gap;

(ii) a plurality of resilient spacers disposed intermediate said panels and providing the air gap;

(iii) means for mounting said shield on the bottom of said housing to protect the lens and the light source; and (iv) a second plurality of resilient spacers disposed intermediate said door and an adjacent one of said panels and providing an air gap therebetween.

10. A shielded luminaire including (A) a luminaire comprising:

(i) an open-bottom housing for a light source; and (ii) a lens-bearing door movably mounted on said housing for closing the open bottom thereof and for mounting a lens below the light source; said door having apertures and being pivotally secured to the back of said housing; and (iii) a resilient releasable latch for releasably securing said door to the front of said housing, said latch having one latch end portion secured to said door, another latch end portion pivotable between a non-engaging orientation wherein it does not engage said housing and an engaging orientation wherein it is loosely and releasably secured to said housing, and a latch intermediate portion connecting said latch end portions; and (B) a shield comprising:

(i) an overlapping pair of substantially rigid but slightly flexible transparent planar panels separated by an air gap;

(ii) a plurality of resilient spacers disposed intermediate said panels and providing the air gap;

(iii) means for mounting said shield on the bottom of said housing to protect the lens and the light source, said mounting means including at one end of said shield a pair of nut-and-bolt assemblies for releasably mounting said one shield end to said door aperatures and at the other end of said shield means for loosely and releasably engaging said latch intermediate portion.

11. A shielded luminaire including (A) a luminaire comprising:

(i) an open-bottom housing for a light source; and (ii) a lens-bearing door movably mounted on said housing for closing the bottom thereof and for mounting a lens below the light source; and (B) a shield comprising:

(i) an overlapping, substantially vertically aligned pair of substantially rigid but slightly flexible transparent planar panels separated by an air gap and defining a planar surface adjacent and substantially parallel to the lens, each of said panels being polycarbonate and about 0.5" thick;

(ii) a first plurality of slightly shock-absorbing resilient spacers disposed intermediate said panels and providing the air gap therebetween, and a second plurality of slightly shock-absorbing resilient spacers disposed intermediate said door and an adjacent one of said panels and providing an air gap therebetween, said spacers being about 0.2–0.5" long; and (iii) means for mounting said shield on the bottom of said housing to protect the lens and the light source.

12. A shielded luminaire including (A) a luminaire comprising:

(i) a housing for a light source;

(ii) a lens-bearing door with apertures pivotally secured to the back of said housing, and (iii) a resilient releasable latch for releasably securing said door to the front of said housing, said latch having one latch end portion secured to said door, another latch end portion pivotable between a non-engaging orientation wherein it does not engage said housing and an engaging orientation wherein it is loosely and releasably secured to said housing, and a latch intermediate portion connecting said latch end portions; and (B) a shield comprising:

(i) an overlapping pair of substantially rigid but slightly flexible transparent planar panels separated by an air gap and held together by a plurality of bolt-and-nut assemblies;

(ii) a plurality of resilient spacers disposed on said bolts of said assemblies intermediate said panels to provide the air gap and on said bolts of said assemblies above the upper panel to space said upper panel from said door;

(iii) means for mounting said shield on the bottom of said housing to protect the lens and the light source, said mounting means including adjacent one end of said shield at least one bolt of said assemblies extending through a respective aperture in said door for releasably mounting said one shield end on said door with a nut, and adjacent the other end of said shield means for loosely and releasably securing said other end of said shield to said latch intermediate portion.

13. The of shielded luminaire of claim 12 wherein said securing means includes a tang secured to said upper panel and defining therewith a resiliently openable clip for loosely and releasably receiving and maintaining therein said latch intermediate portion.

14. A shielded luminaire including (A) a luminaire comprising:

(i) an open-bottom housing for a light source; and (ii) a lens-bearing door movably mounted on said housing for closing the open bottom thereof and for mounting a lens below the light source; and (B) a shield comprising:

(i) an overlapping pair of substantially rigid but slightly flexible transparent planar panels separated by an air gap;

(ii) a plurality of resilient spacers disposed intermediate said panels and providing the air gap;

(iii) means for mounting said shield on the bottom of said housing to protect the lens and the light source.

15. The shielded luminaire of claim 14 wherein said shield has a planar surface adjacent and substantially parallel to the lens.

16. The shielded luminaire of claim 14 wherein said panels are polycarbonate and about 0.5" thick.

17. The shielded luminaire of claim 14 wherein said spacers are slightly shock-absorbing and about 0.2–0.5" long.

18. The shielded luminaire of claim 14 wherein said panels are substantially vertically aligned.

19. The shielded luminaire of claim 14 wherein said panels are formed of plastic.

20. A shield for use on a luminaire which includes a front, a back, an open-bottom luminaire housing for a luminaire light source and a lens-bearing luminaire door movably mounted on the luminaire housing for closing the open bottom thereof and for mounting a luminaire lens below the luminaire light source, the luminaire door having apertures and being pivotally secured to the back of the luminaire housing, and the luminaire additionally including a resilient releasable luminaire latch for releasably securing the luminaire door to the front of the luminaire housing, the luminaire latch having one latch end portion secured to the door, another latch end portion pivotable between a non-engaging orientation wherein it does not engage the luminaire housing and an engaging orientation wherein it is loosely and releasably secured to the luminaire housing, and a luminaire latch intermediate portion connecting the latch end portions;

said shield comprising:

(A) an overlapping air of substantially rigid but slightly flexible transparent planar panels separated by an air gap;

(B) a plurality of resilient spacers disposed intermediate said panels and providing the air gap; and (C) means for mounting said shield on the bottom of the luminaire housing to protect the luminaire lens and the luminaire light source; said mounting means including at one end of said shield a pair of nut-and-bolt assemblies for releasably mounting said one shield end on luminaire door apertures and at another end of said shield means for loosely and releasably engaging the luminaire latch intermediate portion.

21. A shield for use on a luminaire including an open-bottom luminaire housing for a luminaire light source and a lens-bearing luminaire door movably mounted on the luminaire housing for closing the bottom thereof and for mounting a luminaire lens below the luminaire light source, said shield comprising:

(A) an overlapping, substantially vertically aligned pair of substantially rigid but slightly flexible transparent planar panels separated by an air gap and defining a planar surface in use adjacent and substantially parallel to the luminaire lens, each of said panels being polycarbonate and about 0.5" thick;

(B) a first plurality of slightly shock-absorbing resilient spacers disposed intermediate said panels and providing the air gap therebetween, and a second plurality of slightly shock-absorbing resilient spacers disposed intermediate the luminaire door and an adjacent one of said panels and providing an air gap therebetween, said spacers being about 0.2–0.5" long; and (C) means for mounting said shield on the bottom of the luminaire housing to protect the luminaire lens and the luminaire light source.

22. A shield for use on a luminaire including a front, a back, a housing for a luminaire light source, a lens-bearing luminaire door with apertures pivotally secured to the back of the luminaire housing, and a resilient releasable luminaire latch for releasably securing the luminaire door to the front of the luminaire housing, the luminaire latch having one latch end portion secured to the luminaire door, another latch end portion pivotable between a non-engaging orientation wherein it does not engage the luminaire housing and an engaging orientation wherein it is loosely and releasably secured to the luminaire housing, and a luminaire latch intermediate portion connecting the latch end portions; said shield comprising:

(i) an overlapping pair of substantially rigid but slightly flexible transparent planar panels separated by an air gap and held together by a plurality of bolt-and-nut assemblies;

(ii) a plurality of resilient spacers disposed on said bolts of said assemblies intermediate said panels to provide the air gap and on said bolts of said assemblies above the upper panel to space said upper panel from the luminaire door; and (iii) means for mounting said shield on the bottom of the luminaire housing to protect the lens and the light source, when said shield is mounted on the luminaire said mounting means including adjacent one end of said shield at least one bolt of said assemblies extending through a respective aperture in the luminaire door for releasably mounting said one shield end on the luminaire door with a nut, and adjacent another end of said shield means for loosely and releasably securing said other end of said shield to the luminaire latch intermediate portion.

23. The shield of claim 22 wherein said securing means includes a tang secured to said upper panel and defining therewith a resiliently openable clip for loosely and releasably receiving and maintaining therein a luminaire latch intermediate portion.

* * * * *